US007007527B1

(12) United States Patent
Zehrung

(10) Patent No.: US 7,007,527 B1
(45) **Date of Patent: *Mar. 7, 2006**

(54) ELECTRIFIED CYLINDRICAL LOCK

(76) Inventor: Raymond E. Zehrung, 52 Laxalt Dr., Mound House, NV (US) 89706

( * ) Notice: Subject to any disclaimer, the term of this patent is extended or adjusted under 35 U.S.C. 154(b) by 0 days.

This patent is subject to a terminal disclaimer.

(21) Appl. No.: 10/987,520

(22) Filed: Nov. 12, 2004

Related U.S. Application Data

(62) Division of application No. 10/384,500, filed on Mar. 7, 2003, now Pat. No. 6,856,221.

(51) Int. Cl.
*E05B 47/06* (2006.01)

(52) U.S. Cl. ..... 70/278.7; 70/283; 70/461; 70/462; 292/144; 292/244; 292/251.5; 292/DIG. 60

(58) Field of Classification Search ..... 70/277, 70/283, 279.1, 278.7, 461, 462, 276; 292/144, 292/244, DIG. 60, 251.5
See application file for complete search history.

(56) References Cited

U.S. PATENT DOCUMENTS

| | | | | | |
|---|---|---|---|---|---|
| 1,833,572 | A | * | 11/1931 | Hardesty | 70/262 |
| 2,802,357 | A | * | 8/1957 | Smith | 70/283 |
| 3,054,282 | A | * | 9/1962 | Bacon | 70/264 |
| 3,103,603 | A | | 9/1963 | Reutter | 310/30 |
| 3,683,239 | A | | 8/1972 | Sturman | 361/194 |
| 3,806,850 | A | | 4/1974 | McFarlin | 335/203 |
| 4,046,244 | A | | 9/1977 | Velazquez | 400/124.17 |
| 4,148,092 | A | * | 4/1979 | Martin | 361/172 |
| 4,679,017 | A | | 7/1987 | Mishler et al. | 335/164 |
| 4,736,970 | A | * | 4/1988 | McGourty et al. | 292/359 |
| 5,010,750 | A | * | 4/1991 | Boser et al. | 70/276 |
| 5,044,678 | A | * | 9/1991 | Detweiler | 292/144 |
| 5,076,622 | A | * | 12/1991 | Detweiler | 292/201 |
| 5,083,122 | A | * | 1/1992 | Clark | 340/5.22 |
| 5,246,258 | A | * | 9/1993 | Kerschenbaum et al. | 292/144 |
| 5,487,289 | A | * | 1/1996 | Otto et al. | 70/279.1 |
| 5,884,515 | A | * | 3/1999 | Milman | 70/472 |
| 6,009,615 | A | | 1/2000 | McKean et al. | 29/602.1 |
| 6,412,318 | B1 | * | 7/2002 | Shen | 70/217 |
| 6,788,177 | B1 | | 9/2004 | Weber | 335/268 |
| 6,856,221 | B1 | * | 2/2005 | Zehrung | 335/220 |
| 2002/0149456 | A1 | | 10/2002 | Krimmer et al. | 335/220 |

OTHER PUBLICATIONS

Schlage D-Series Knobs Service Manual, Rev. 8/01, pp. 18-19, published 2001 by Ingersoll-Rand Architectural Hardware, International Division, Mississauga, Ontario, Canada.

Schlage D-Series Levers Service Manual, Rev. 8/01, pp. 22-25, published 2001 by Ingersoll-Rand Architectural Hardware, International Division, Mississauga, Ontario, Canada.

* cited by examiner

*Primary Examiner*—Lloyd A. Gall
(74) *Attorney, Agent, or Firm*—Menlo Patent Agency LLC; David R. Gildea

(57) ABSTRACT

An electrified cylindrical lock having a reversible solenoid that can be easily changed over between active push and active pull. The solenoid includes a coil and an armature that may be assembled for an active push or an active pull of a latch member. The coil has a front end and a rear end. The front coil end always faces toward the latch member and the rear end always faces away from the latch member. The armature includes a magnetic slug. The slug is disposed at the rear coil end for the active push mode or disposed at the front coil end for the active pull mode.

16 Claims, 6 Drawing Sheets

ELECTRIFIED CYLINDRICAL LOCK

CROSS REFERENCE TO RELATED APPLICATION

This patent application is a division of prior application Ser. No. 10/384,500 entitled "Reversible Solenoid" filed Mar. 7, 2003 by the same inventor and issued Feb. 15, 2005 as patent number U.S. Pat. No. 6,856,221 B1.

BACKGROUND OF THE INVENTION

1. Field of the Invention

The invention relates generally to electrified cylindrical locks and more particularly to an electrified cylindrical lock having a reversible solenoid.

2. Description of the Prior Art

Solenoids are commonly used for electric control of locks. Circumstances such as building codes and user preferences dictate whether the locks are required to operate as fail safe (electrically locked) or as fail secure (electrically unlocked). Therefore, to provide full coverage a lock manufacturer must supply the locks in both fail safe and fail secure versions. Of course, this can be accomplished with two different solenoids, one for active push operation and the other for active pull operation. However, this doubles the manufacturer's overhead costs for forecasting, purchasing, inventorying and maintaining two solenoids instead of one. From a user's point-of-view, the two solenoid approach has a disadvantage that he cannot change between fail safe and fail secure without reordering.

There is a need for an electrified cylindrical lock having a solenoid that can be reversed to switch over between active push and active pull operation.

SUMMARY OF THE INVENTION

It is therefore an object of the present invention to provide an electrified cylindrical lock having a reversible solenoid that can be easily changed over between active push and active pull.

Briefly, in a preferred embodiment, the solenoid includes a coil, an armature, and a case that may be assembled for either active push or active pull of a latch member. The coil has a front end and a rear end. The front end always faces toward the latch member and the rear end always faces away from the latch member. The armature includes a magnetic slug. The slug is disposed at the rear coil end for the active push mode or disposed at the front coil end for the active pull mode. Energizing the coil draws the slug toward the front coil end for pushing the latch member away from the coil for the active push mode and draws the slug toward the rear coil end for pulling the latch member toward the coil for the active pull mode without reversing the coil with respect to the latch member or to a device such as a lock that uses the latch member.

These and other objects and advantages of the present invention will no doubt become obvious to those of ordinary skill in the art after having read the following detailed description of the preferred embodiments which are illustrated in the various figures.

IN THE DRAWINGS

DETAILED DESCRIPTION OF THE PREFERRED EMBODIMENTS

Figure 1A:
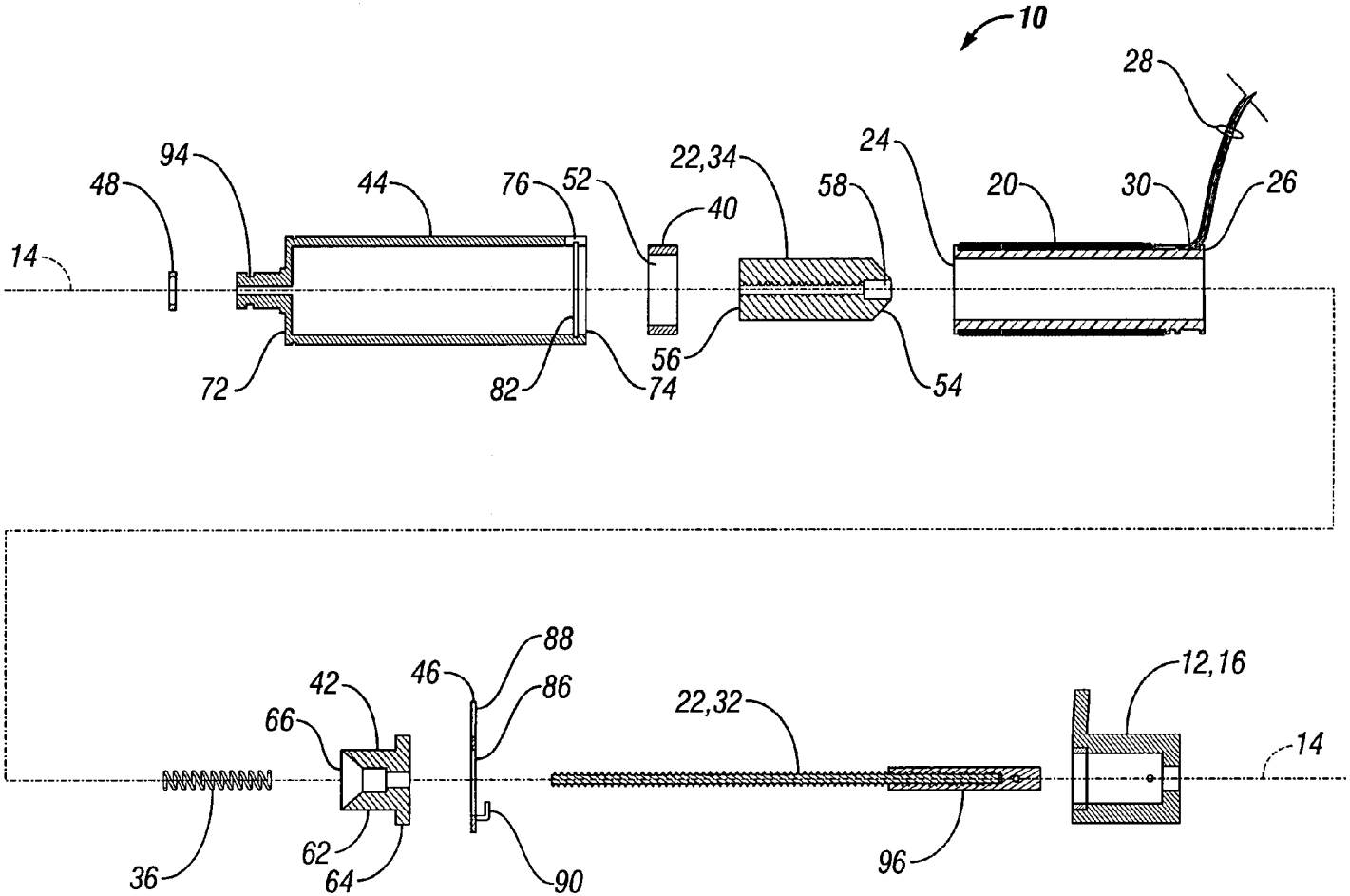
FIGS. 1A and 1B are exploded assembly drawings of a reversible solenoid of the present invention for active push and active pull operation, respectively.
Figure 1B:
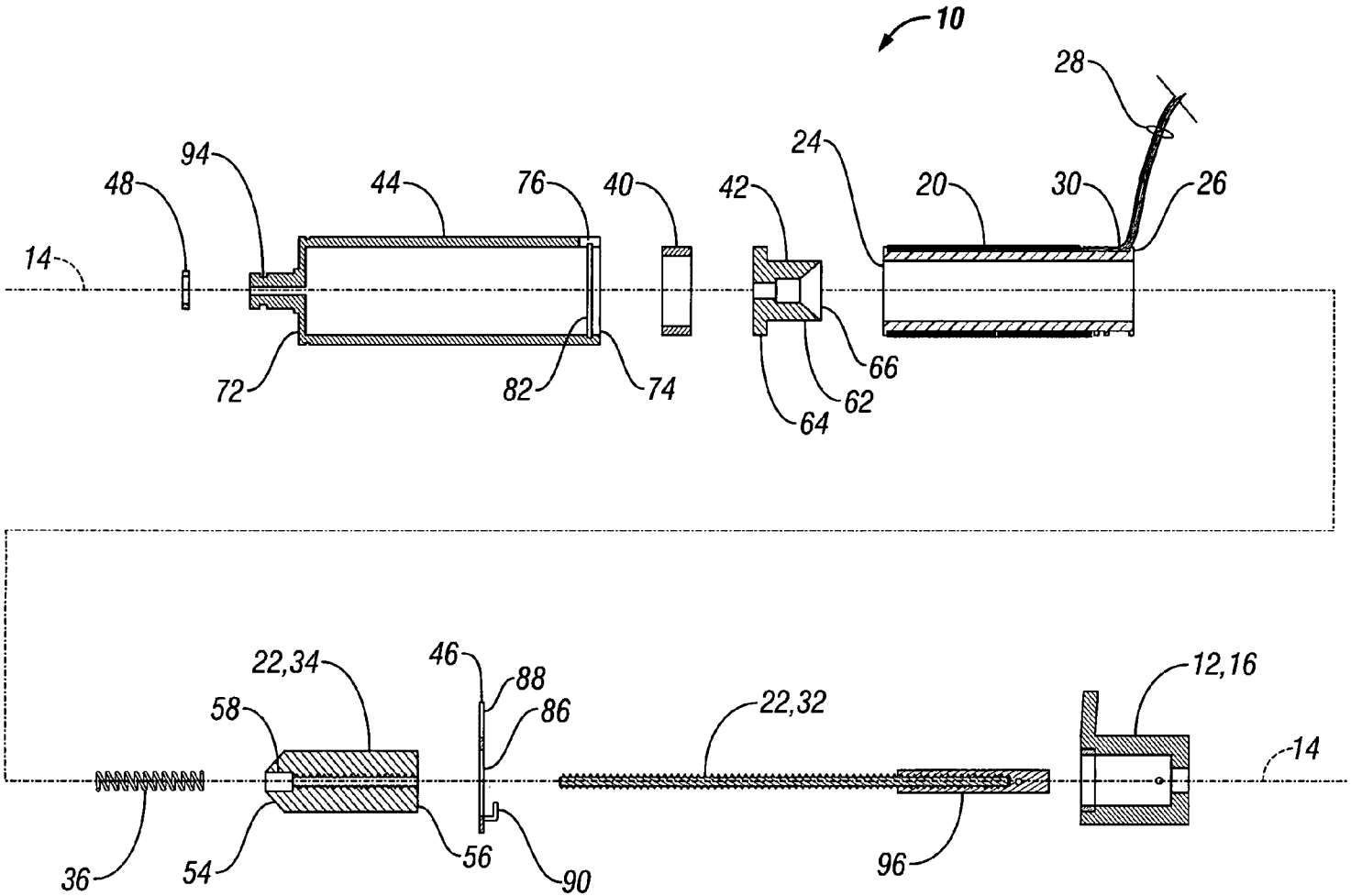
Figure 2A:
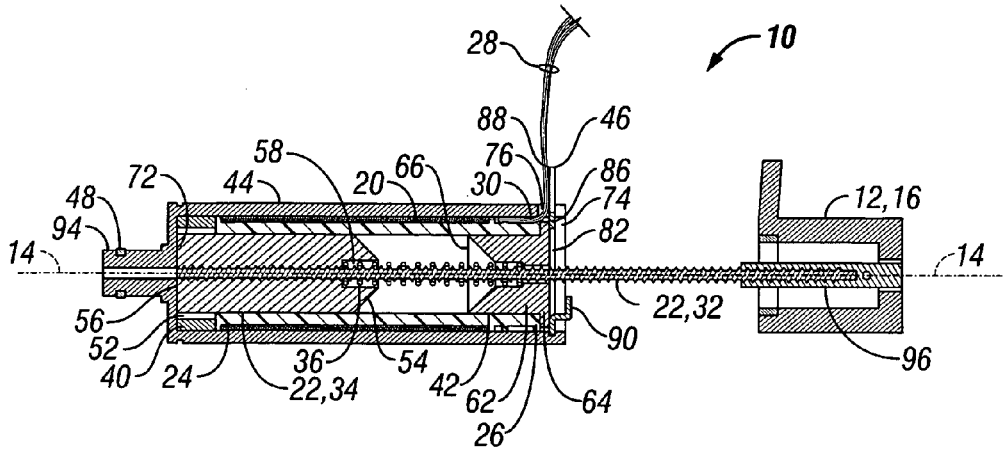
FIGS. 2A and 2B are cross-sectional views of the solenoid of the present invention at rest for active push and active pull operation, respectively.
Figure 2B:
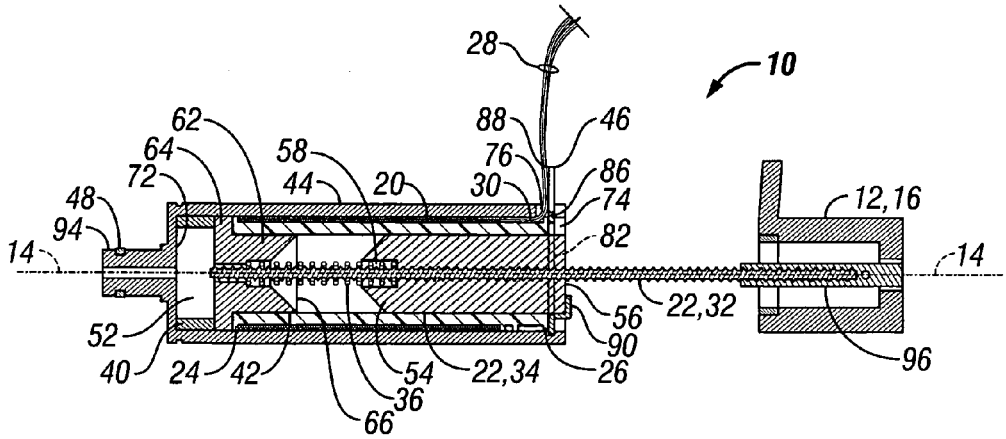

FIGS. 1A–B and 2A–B show a reversible solenoid of the present invention referred to by a reference number 10. The solenoid 10 can be assembled for operation in an active push mode for pushing an object 12 along an axis 14 away from the solenoid 10 or an active pull mode for pulling the object 12 along the axis 14 toward the solenoid 10 when the solenoid 10 is energized. In an exemplary embodiment, the object 12 may be a latch member 16 (FIGS. 3 and 4) used in a chassis 18 (FIGS. 3 and 4) for a door lock 19 (FIG. 4). FIGS. 1A–B are exploded assembly drawings of the solenoid 10. FIGS. 2A–B are cross-sectional views of the solenoid 10 when the solenoid 10 is at rest (de-energized). FIGS. 1A and 2A show the solenoid 10 when it is assembled for active push and passive pull operation. FIGS. 1B and 2B show the solenoid 10 when it is assembled for active pull and passive push operation.

The solenoid 10 includes a coil 20 and an armature 22 on the axis 14. The coil 20 has a rear coil end 24 and a front coil end 26. Wires 28 for carrying electrical current for energizing the coil 20 enter the coil 20 at a wire entry point 30 at the front coil end 26. The coil 20 is always disposed so the front coil end 26 is closer to the object 12 and the rear coil end 24 is farther from the object 12.

The armature 22 includes an armature shaft 32 connected to the object 12, a magnetic armature slug 34 disposed on the armature shaft 32, and a spring 36 coiled about the armature shaft 32 for biasing the slug 34. Preferably, the slug 34 is made of a magnetic material such as iron or steel that reacts to an external magnetic field but does not hold the field to become a permanent magnet.

For the active push mode, the armature 22 responds to a magnetic field from the coil 20 when the coil 20 is energized to actively push the object 12 away from the coil 20 and responds to the bias of the spring 36 when the coil 20 is de-energized to passively pull the object 12 toward the coil 20. For the active pull mode, the armature 22 responds to the magnetic field from the coil 20 when the coil 20 is energized to actively pull the object 12 toward the coil 20 and responds to the bias of the spring 36 when the coil 20 is de-energized to passively push the object 12 away from the coil 20.

The solenoid 10 also includes a ring spacer 40, a seat 42, a case 44, a coil retainer clip 46, and a case retainer clip 48. The ring spacer 40 has a through hole 52 on the axis 14. The slug 34 has an inner end 54 and an outer end 56. The inner end 54 always remains within the coil 20. For improved magnetic efficiency, the inner end 54 is chamfered. A cavity 58 in the inner end 54 encloses and retains one end of the spring 36. The slug 34 is end-for-end reversed on the axis 14 when the solenoid 10 is switched between the active push mode and the active pull mode so that the inner end 54 faces toward the object 12 for the active push mode and away from the object 12 for the active pull mode.

For the active push mode, the slug 34 is threaded to a location on the armature shaft 32 that is proximate to the rear coil end 24. When the coil 20 is at rest (not-energized), the slug 34 is urged by the spring 36 so that the outer end 56 is pushed into the through hole 52, thereby passively pulling the object 12 toward the solenoid 10. In a preferred embodiment, for a coil 20 having a length between the rear coil end 24 and the front coil end 26 of about one inch, the outer end 56 protrudes about 0.150 inches through the rear coil end 24 into the through hole 52. When the coil 20 is energized, the slug 34 is drawn further into the coil 20 so that the outer end 56 is about flush with the rear coil end 24 or protrudes less than about 0.15 inches, thereby actively pushing the object 12 away from the solenoid 10.

For the active pull mode, the slug 34 is threaded to a location on the armature shaft 32 that is proximate to the front coil end 26. When the coil 20 is at rest (de-energized), the slug 34 is urged by the spring 36 so that the outer end 56 protrudes through the front coil end 26, thereby passively pushing the object 12 away from the solenoid 10. In a preferred embodiment, for a coil 20 having a length between the rear coil end 24 and the front coil end 26 of about one inch, the outer end 56 protrudes about 0.150 inches through front coil end 26. When the coil 20 is energized, the slug 34 is drawn further into the coil 20 so that the outer end 56 is about flush with the front coil end 26 or protrudes less than about 0.20 inches, thereby actively pulling the object 12 toward the solenoid 10.

The seat 42 has an inner cylindrical section 62 having a seat end 66 and an outer cylindrical section 64. The inner section 62 has an outside diameter less than the inside diameter of the coil 20 and always remains within the coil 20. The seat end 66 has a concave reverse chamfer that approximately matches the chamfer of the inner end 54 of the slug 34. A cavity in the seat end 66 encloses and retains one end of the spring 36. The seat end 66 always faces the inner end 54 of the slug 34. The seat 42 is end-for-end reversed on the axis 14 when the solenoid 10 is switched between the active push mode and the active pull mode so that the seat end 66 faces away from the object 12 for the active push mode and toward the object 12 for the active pull mode. For the active push mode, the seat 42 is located proximate to the front coil end 26. For the active pull mode, the seat 42 is located proximate to the rear coil end 24.

The case 44 has a closed rear end 72 and an open front end 74 having a notch 76. The inside diameter of the case 44 approximately matches the outside diameters of the coil 20, the ring spacer 40, and the outer section of the seat 42. The coil retainer clip 46 is sprung into a front annular groove 82 near the front end 74 on the inside of the case 44.

For the active pull mode, the slug 34 is threaded to a location on the armature shaft 32 that is proximate to the front coil end 26. When the coil 20 is at rest (de-energized), the slug 34 is urged by the spring 36 so that the outer end 56 protrudes through the front coil end 26, thereby passively pushing the object 12 away from the solenoid 10. In a preferred embodiment, for a coil 20 having a length between the rear coil end 24 and the front coil end 26 of about one inch, the outer end 56 protrudes about 0.150 inches through front coil end 26. When the coil 20 is energized, the slug 34 is drawn further into the coil 20 so that the outer end 56 is about flush with the front coil end 26 or protrudes less than about 0.15 inches, thereby actively pulling the object 12 toward the solenoid 10.

The coil retainer clip 46 includes a horse shoe shaped spring section 86, handles 88 attached to and in the same plane as the spring section 86, and an L-shaped flange 90 attached to the spring section 86. The handles 88 enables an assembler to compress the spring section 86 in order to engage and fit into the annular groove 82. The flange 90 retains the armature slug 34 in the solenoid 10 when the solenoid 10 is assembled for the active pull mode. Typically, after the solenoid 10 has been installed into the chassis 18 (FIG. 3), the flange 90 is redundant.

The case 44 also includes a rear annular groove 94. The case retainer clip 48 is sprung into the groove 94 for fixing and retaining the solenoid 10 within the chassis 18 (FIGS. 3 and 4) or other external device using the solenoid 10. The wire entry point 30 aligns with the notch 76 allowing the wires 28 to enter the solenoid 10.

The outer section 64 of the seat 42 has an outside diameter about equal to the outside diameter of the coil 20 and a length between inner and outer sides along the axis 14 of less than about 1/10 the length of the coil 20 (less than about 0.100 inches for a preferred embodiment) and preferably about 1/20 the length of the coil 20 (less than about 0.050 inches for a preferred embodiment). It may be noted that the wire entry point 30 moves away from the coil retainer clip 46 by the length of the outer section 64 of the seat 42 when the solenoid 10 is switched between the active push and pull modes.

Figure 3:
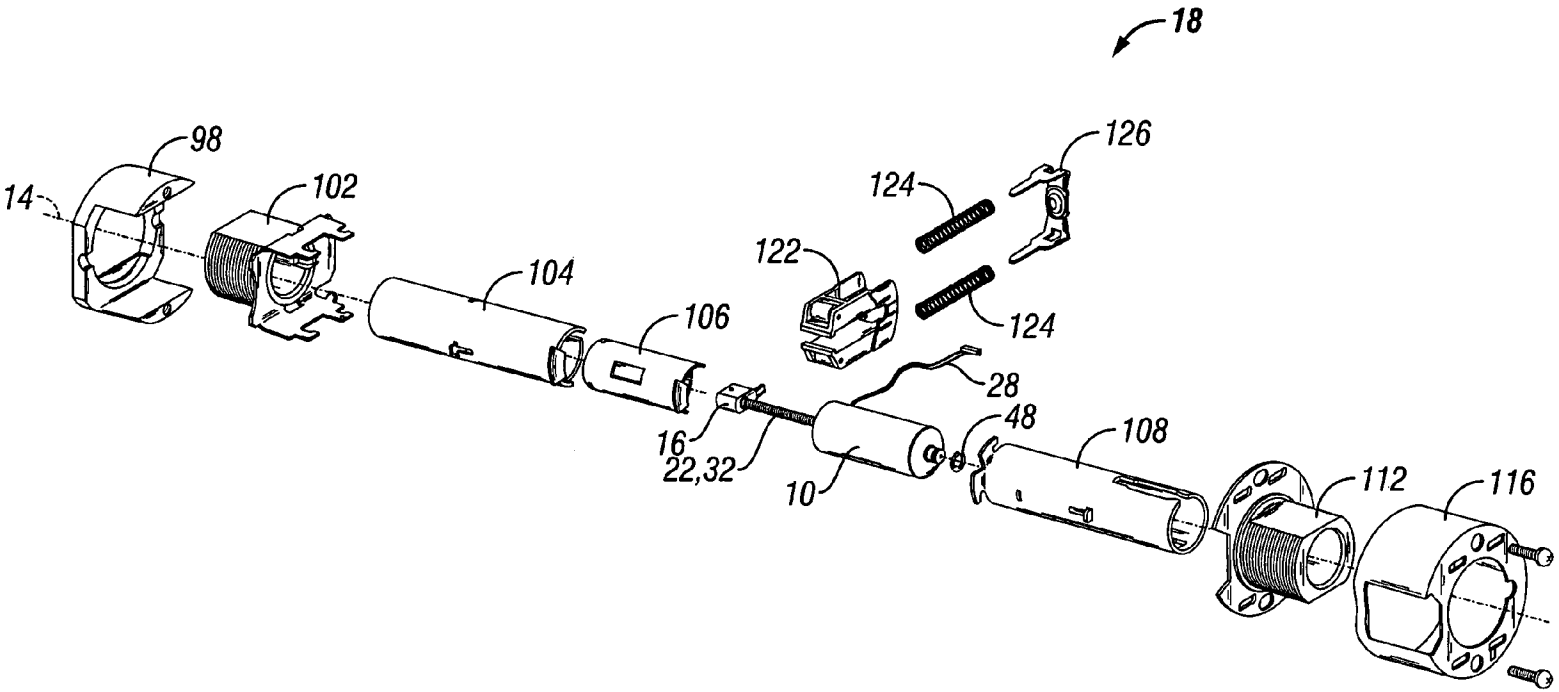
FIG. 3 is an exploded assembly drawing of a cylindrical lock chassis including the reversible solenoid of the present invention.
Figure 4:
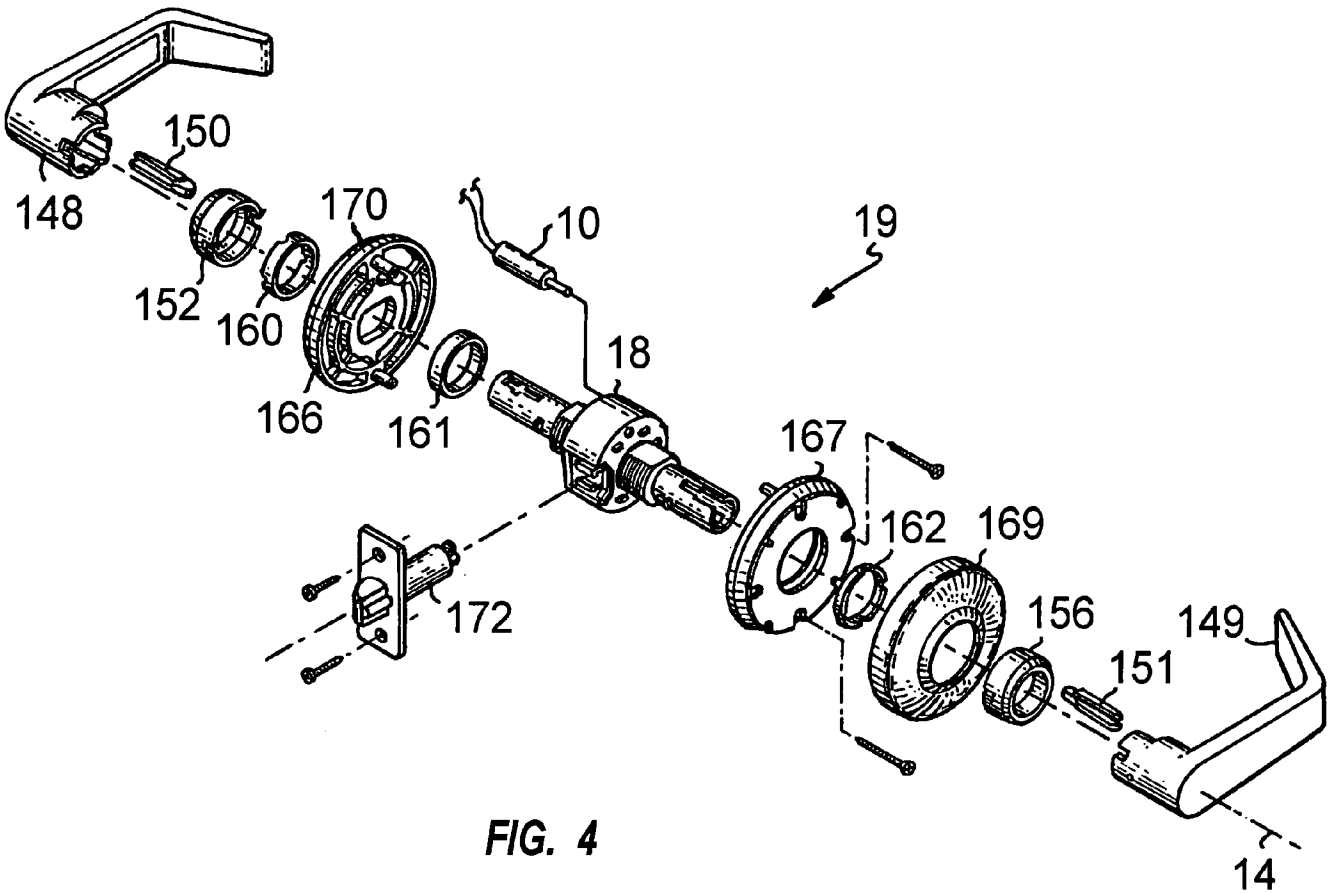
FIG. 4 is an exploded assembly drawing of a cylindrical lock including the chassis of FIG. 3.

Importantly, the length of the outer section 64 must be small enough that so wires 28 are not stretched when the solenoid 10 is converted between active push and pull modes for the same chassis 18 (FIG. 3) or lock 19 (FIGS. 3 and 4). Further, the notch 76 must be long enough to accommodate the difference in position of the wire entry point 30 with respect to the fixed case 44. Alternatively, a second ring spacer having a length along the axis 14 equal to the length of the outer section 64 may be used to avoid any movement of the wire entry point 30 between the active push and active pull modes. The second spacer ring would be disposed adjacent to the spacer ring 40 for the active push mode and between the front coil end 26 and the coil retainer clip 46 for the active pull mode.

The solenoid 10 may be assembled without tools from a solenoid kit for operation either as active push or active pull. Because the coil 20 is a small portion of the total cost of the kit, the kit may include both 12 volt and 24 volt versions of the coil 20. A single kit of parts may be ordered and inventoried by a supplier, inventoried and shipped, and ordered, inventoried, assembled and if necessary reassembled by a receiver for four versions of the solenoid 10: active push 12 volt, active push 24 volt, active pull 12 volt and active pull 24 volt, thereby reducing handling costs.

The armature 22 in a preferred embodiment includes a swivel 96. The swivel 96 is pinned into the latch 16 to enable the solenoid 10 and the latch member 16 to have a few degrees of pivoting freedom to prevent binding.

FIG. 3 is an exploded assembly drawing of an exemplary cylindrical lock chassis 18 of the present invention using the solenoid 10. The latch member 16 is threaded onto the shaft 32 of the armature 22. The armature shaft 32 pushes and pulls the latch member 16 as described above so that the latch member 16 takes on lock and unlock positions. The lock and unlock positions control the state of the chassis 18 for locked and unlocked states, respectively.

The chassis 18 includes a strengthening fire block member 98, a first frame 102, a first spindle 104, a second spindle 106, the latch member 16, the solenoid 10 with the wires 28 and the case retainer clip 48, a third spindle 108, a second frame 112 and a housing 116 assembled along the axis 14, and a slide and roller assembly 122 including springs 124 and spring seat 126 orthogonal to the axis 14. The slide and roller assembly 122 accepts the latch member 16 for providing the locked and unlocked states of the chassis 18. In various embodiments the chassis 18 can be constructed as actively electrically locked (fail safe) and actively electrically unlocked (fail secure). In the exemplary chassis 10, the fail safe is active pull and the fail secure is active push.

FIG. 4 is an exploded assembly drawing of an exemplary lock 19 using the chassis 18 having the solenoid 10 installed within the chassis 18. The lock 19 is locked or unlocked according to the locked or unlocked state, respectively, of the chassis 18. The lock 19 includes the chassis 18, first and second handles 148 and 149, first and second keys 150 and 151, first and second drivers 152 and 156, first and second castle nuts 160 and 162, a door spacer 161, and first and second trim roses 166 and 167 with first and second trim roses covers 169 and 170 assembled along the axis 14; and a latch 172 orthogonal to the axis 14. The latch 172 locks and unlocks a door to a wall.

Parts and information for the chassis 18 and the lock 19 (except for the solenoid 10) are available for 80 series locks from Schlage Commercial Lock Division of Ingersoll-Rand having administrative offices in Colorado Springs, Colo. Examples of 80 series locks include models D80PDEL, D80PDEU, D80BDEL and D80BDEU. Those of ordinary skill in the art should note that the solenoid 10 of the present invention may be used with parts for other Schlage models or with parts from other manufacturers such as Cal-Royal Products, Inc. of City of Commerce, Calif.; Sargent Lock of New Haven Conn., a subsidiary of subsidiary of Assa Abloy Group Company of Sweden; Corbin-Russwin of Monroe, N.C., a subsidiary of YSG Door Security Hardware which is a subsidiary of Assa Abloy Group Company of Sweden; Yale Locks of Monroe, N.C., a subsidiary of YSG Door Security Hardware which is a subsidiary of Assa Abloy Group Company of Sweden; Arrow Locks of Brooklyn, N.Y., a subsidiary of Assa Abloy Group Company of Sweden; Falcon Locks and Security Products of Brea, Calif., a subsidiary of Ingersoll-Rand; and Marks Locks of Amityville, N.Y.

Figure 6:
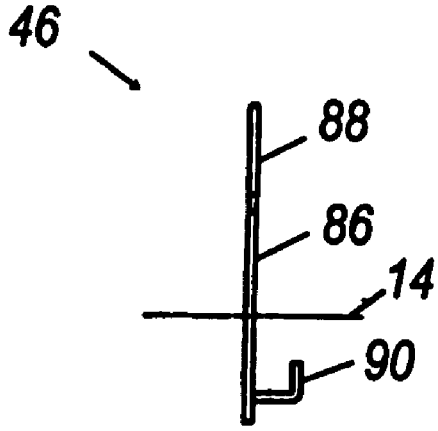
FIG. 6 is a side view of the coil retainer clip of FIG. 5.
Figure 5:
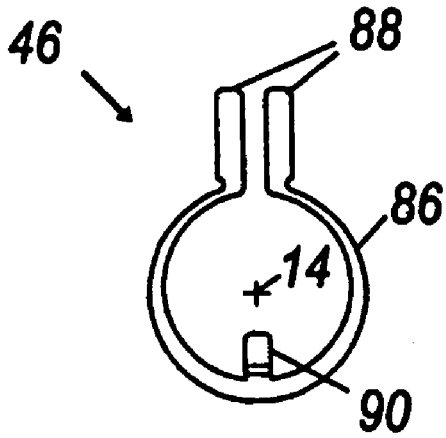
FIG. 5 is a front view of a coil retainer clip of the reversible solenoid of the present invention.

FIGS. 5 and 6 are front and side views of the coil retainer clip 46 with respect of the axis 14. The coil retainer clip 46 includes the spring section 86, the handles 88 and the flange 90. As described above the handles 88 are used to spring the spring section 86 into the groove 82 (FIGS. 1A–B and 2A–B) in order to retain the coil 20, the seat 42 and the slug 34 within the solenoid 10.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An electrified cylindrical lock, comprising:

a chassis having locked and unlocked states; the chassis having a latch member having lock and unlock positions for determining said locked and unlocked states, respectively, and a solenoid including an armature slug mechanically coupled to said latch member and a coil magnetically coupled to said slug, the coil having a rear coil end and a front coil end, said slug disposed proximate to said rear coil end for an active push on said latch member and disposed proximate to said front coil end for an active pull on said latch member for controlling said lock and unlock positions.

2. The lock of claim 1, further comprising:

first and second trim assemblies fixed to a door; and wherein:

the chassis locks and unlocks the first and second trim assemblies with said locked and unlocked states, respectively, for locking and unlocking said door to a wall.

3. The lock of claim 1, wherein:

said front coil end is disposed closer to said latch member than said rear coil end; and energizing the coil draws the slug toward said front coil end for pushing said latch member away from the coil for said active push and draws the slug toward said rear coil end for pulling said latch member toward the coil for said active pull.

4. The lock of claim 3, wherein:

the slug includes an inner end facing toward said front coil end for said active push and facing toward said rear coil end for said active pull.

5. The lock of claim 3, wherein:

the slug is end-for-end reversed with respect to said latch member for switching between said active push and said active pull.

6. The lock of claim 3, wherein:

the coil includes wires emerging at a wire entry for carrying electrical current for energizing the coil, said wire entry substantially unmoved with respect to said latch member when the lock is switched between said active push and said active pull.

7. The lock of claim 3, further comprising:

an armature shaft extending through said front coil end for connecting the slug to said latch member.

8. The lock of claim 7, wherein:

the slug is disposed at a first location on the shaft for said active push and a second location on the shaft for said active pull.

9. The lock of claim 7, further comprising:

a seat proximate to said front coil end for limiting travel of the slug toward said front coil end for said active push and proximate to said rear coil end for limiting travel of the slug toward said rear coil end for said active pull, the seat having a through hole for passing the shaft.

10. The lock of claim 9, wherein:

the seat is end-for-end reversed with respect to said latch member for switching between said active push and said active pull.

11. The lock of claim 9, wherein:

the seat includes a first cylindrical section having a seat end proximal to the slug and a second cylindrical section distal from the slug, said first section having a diameter less than an inside diameter of the coil, the second section having a diameter about matching an outside diameter of the coil, said seat end including a cavity facing said slug.

12. The lock of claim 11, further comprising:

a case for housing the coil and the seat, the case having a rear case end and a front case end; and a retainer engaged to the case at said front case end for retaining the coil and the seat within the case.

13. The lock of claim 12, wherein:

the retainer includes a spring section for engaging the case and a flange attached to the spring section for retaining the slug within the solenoid when the solenoid is assembled for said active pull.

14. The lock of claim 12, wherein:

the second section of the seat is disposed between said rear coil end and said rear case end for said active pull and between said front coil end and the retainer for said active push.

15. The lock of claim 12, further comprising:

a spacer ring disposed between said rear case end and said rear coil end for said active push and between said rear case end and said second section for said active pull, the spacer ring having a through hole for passing the slug for said active push.

16. The lock of claim 12, further comprising:

a spring between the slug and the seat for urging the slug away from said front coil end for said active push and away from said rear coil end for said active pull.

* * * * *